US008500501B1

(12) United States Patent
Taylor et al.

(10) Patent No.: US 8,500,501 B1
(45) Date of Patent: Aug. 6, 2013

(54) OUTBOARD MARINE DRIVE COOLING SYSTEM

(75) Inventors: Christopher J. Taylor, Fond du Lac, WI (US); David J. Belter, Oshkosh, WI (US); Charles H. Eichinger, Oshkosh, WI (US)

(73) Assignee: Brunswick Corporation, North Forest, IL (US)

( * ) Notice: Subject to any disclaimer, the term of this patent is extended or adjusted under 35 U.S.C. 154(b) by 58 days.

(21) Appl. No.: 13/163,904

(22) Filed: Jun. 20, 2011

(51) Int. Cl.
*B63H 20/28* (2006.01)

(52) U.S. Cl.
USPC ..... 440/88 K; 440/89 D; 440/89 H

(58) Field of Classification Search
USPC ..... 440/89 H, 89 C, 89 D, 89 B, 88 G, 440/88 J, 88 K
See application file for complete search history.

(56) References Cited

U.S. PATENT DOCUMENTS

| | | | | |
|---|---|---|---|---|
| 3,358,654 | A | 12/1967 | Shanahan et al. | |
| 4,133,284 | A | 1/1979 | Holcroft | |
| 5,036,804 | A | 8/1991 | Shibata | |
| 5,048,467 | A | 9/1991 | Kojima | |
| 5,873,330 | A | 2/1999 | Takahaski et al. | |
| 5,904,605 | A | 5/1999 | Kawasaki et al. | |
| 5,911,610 | A * | 6/1999 | Fujimoto | 440/89 R |
| 6,890,228 | B2 | 5/2005 | Tawa et al. | |
| 6,921,306 | B2 | 7/2005 | Tawa et al. | |
| 7,001,231 | B1 | 2/2006 | Halley et al. | |
| 7,114,469 | B1 | 10/2006 | Taylor | |
| 7,264,520 | B1 | 9/2007 | Taylor et al. | |
| 7,318,396 | B1 * | 1/2008 | Belter et al. | 123/41.8 |

OTHER PUBLICATIONS

Cooling water flow diagram for prior art two-stroke and four-stroke marine engines (undated). This arrangement is hereby admitted prior art, prior to Jun. 11, 2011.

* cited by examiner

*Primary Examiner* — Stephen Avila
(74) *Attorney, Agent, or Firm* — Andrus, Sceales, Starke & Sawall, LLP

(57) ABSTRACT

An outboard marine drive includes a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A 3-pass exhaust manifold is provided. A method is provided for preventing condensate formation in a cylinder head, catalyst housing, and exhaust manifold of an internal combustion engine of a powerhead in an outboard marine drive.

32 Claims, 12 Drawing Sheets

OUTBOARD MARINE DRIVE COOLING SYSTEM

BACKGROUND AND SUMMARY

The invention relates to outboard marine drives, including cooling systems therefor.

Outboard marine drives are known in the prior art and typically include a powerhead having an internal combustion engine, and a downwardly extending driveshaft housing having a lower gearcase driving a propulsor. The engine has a cylinder block and a cylinder head and expels exhaust through an exhaust system having an exhaust manifold, and in some cases a catalyst housing, and an exhaust tube, with the latter extending in the driveshaft housing. A cooling system draws cooling water from a body of water in which the outboard marine drive is operating, and supplies the cooling water through cooling passages to various of the noted components of the outboard marine drive.

The present invention arose during continuing development efforts in the above technology.

DETAILED DESCRIPTION

Prior Art

Figure 1:
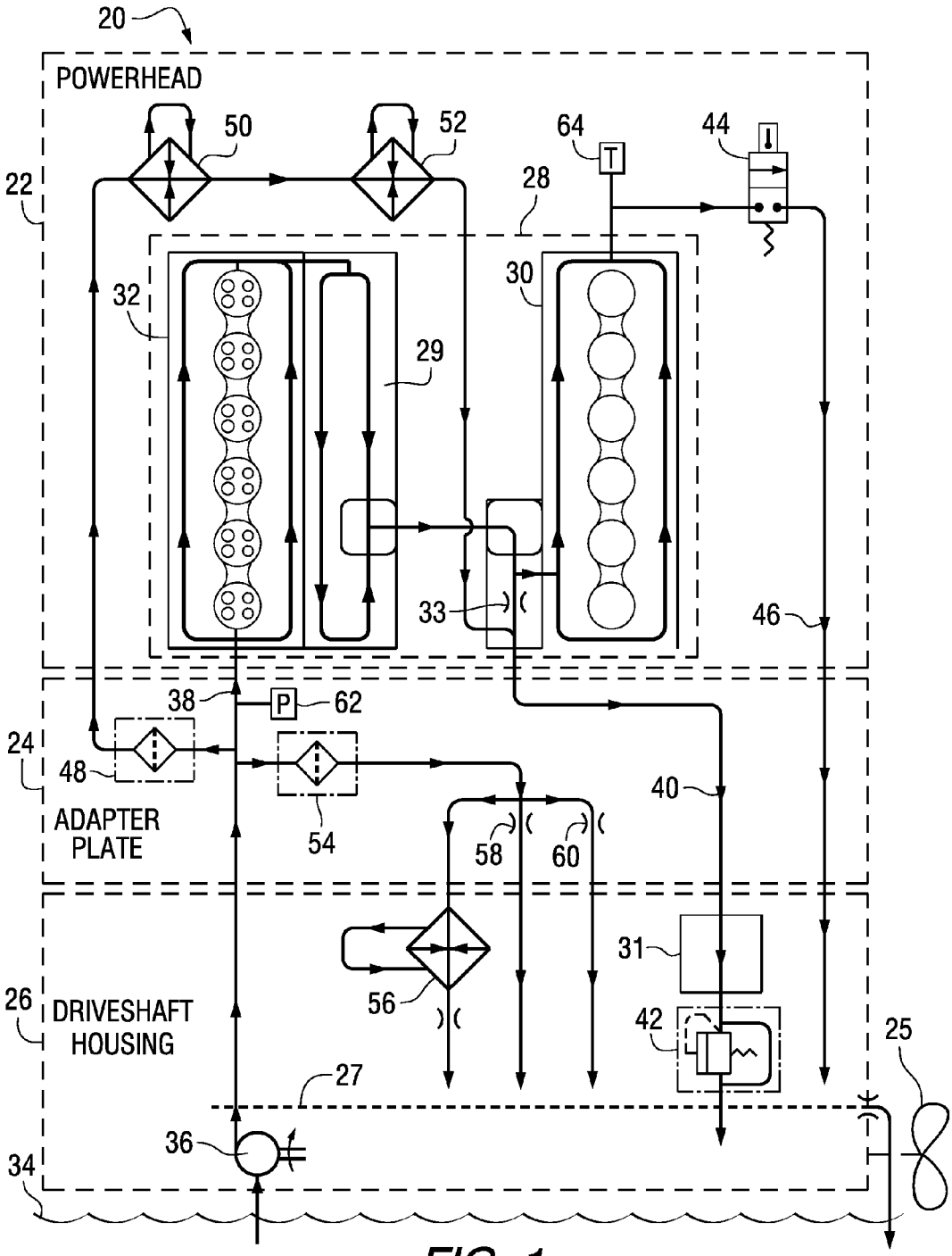
FIG. 1 PRIOR ART
FIG. 1 is a schematic diagram of an outboard marine drive known in the prior art.

FIG. 1 illustrates an outboard marine drive 20 known in the prior art and including a powerhead 22 mounted on top of an adapter plate 24 having a driveshaft housing 26 extending downwardly therefrom and having a lower gearcase 27 driving a propulsor such as a propeller 25. The powerhead includes an internal combustion engine 28 having a cylinder block 30 and a cylinder head 32 and expelling exhaust through an exhaust system having an exhaust manifold 29, and an exhaust tube 31 extending in the driveshaft housing. A cooling system draws cooling water from a body of water 34 in which the outboard marine drive is operated, and supplies the cooling water via water pump 36 initially to the cylinder head as shown at arrow 38, and, after passing through cylinder head 32, then to the exhaust manifold 29. The flow then enters the block 30, where a portion passes through orifice 33 and then to the driveshaft housing as shown at arrow 40 through exhaust tube 31 and poppet valve 42. The cooling water that is supplied to cylinder block 30 is controlled by thermostat 44 and returned to the body of water as shown at arrow 46. Cooling water may also be supplied through strainer 48 to charge air cooler 50 and lube oil cooler 52. This water is then routed through the exhaust tube 31 and poppet valve 42. Cooling water may be supplied through strainer 54 to fuel supply cooling module 56, tell-tale orifice 58, and exhaust sprayer 60. Pressure and temperature sensors may be provided in the system as shown at 62, 64, respectively.

Present Application

FIGS. 2-11 use like reference numerals from above where appropriate to facilitate understanding.

Figure 2:
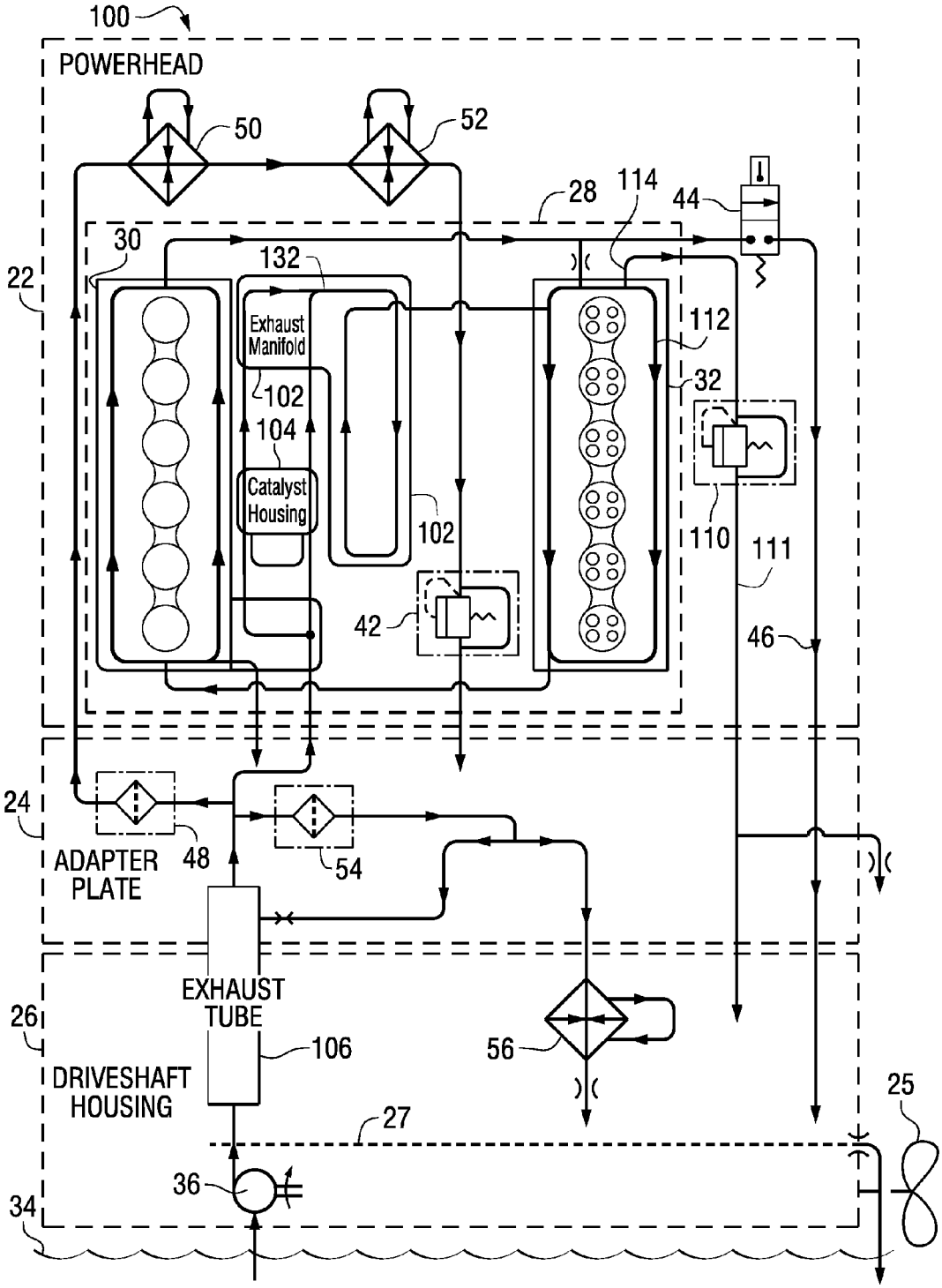
FIG. 2 is like FIG. 1 and illustrates the present disclosure.

FIG. 2 is like FIG. 1 and schematically illustrates an outboard marine drive 100 in accordance with the disclosure. The drive includes powerhead 22 having internal combustion engine 28, and downwardly extending driveshaft housing 26 having a lower gearcase 27 driving a propulsor such as a propeller 25, as above. The engine has the noted cylinder block 30 and cylinder head 32 and expels exhaust through an exhaust system having an exhaust manifold 102, a catalyst housing 104, and an exhaust tube 106 extending in the driveshaft housing. A cooling system draws cooling water from the body of water 34 in which the outboard marine drive is operating, and supplies the cooling water via pump 36 through cooling passages in exhaust tube 106, catalyst housing 104, and exhaust manifold 102, and thereafter through cooling passages in cylinder head 32 and cylinder block 30. The cooling water flowing through the cooling passages in the cylinder head and the cylinder block is pre-heated by passing first through cooling passages in exhaust tube 106, catalyst housing 104, and exhaust manifold 102.

Cooling water flows sequentially in the following order through the cooling passages in exhaust tube 106 then catalyst housing 104 then exhaust manifold 102. The cooling water flows to cylinder head 32 after leaving exhaust manifold 102. Exhaust flows sequentially in the following order through exhaust passages in exhaust manifold 102 then catalyst housing 104 then exhaust tube 106 in driveshaft housing 26. The cooling water and the exhaust flow in opposite directions in at least two, and in various embodiments in all three of, the exhaust tube, the catalyst housing, and the exhaust manifold. The sequential direction of flow of cooling water through the exhaust tube, the catalyst housing, and the exhaust manifold is a first sequential direction. The sequential direction of flow of exhaust through the exhaust manifold, the catalyst housing, and the exhaust tube is a second sequential direction. The noted second sequential direction is opposite to the noted first sequential direction.

Figure 3:
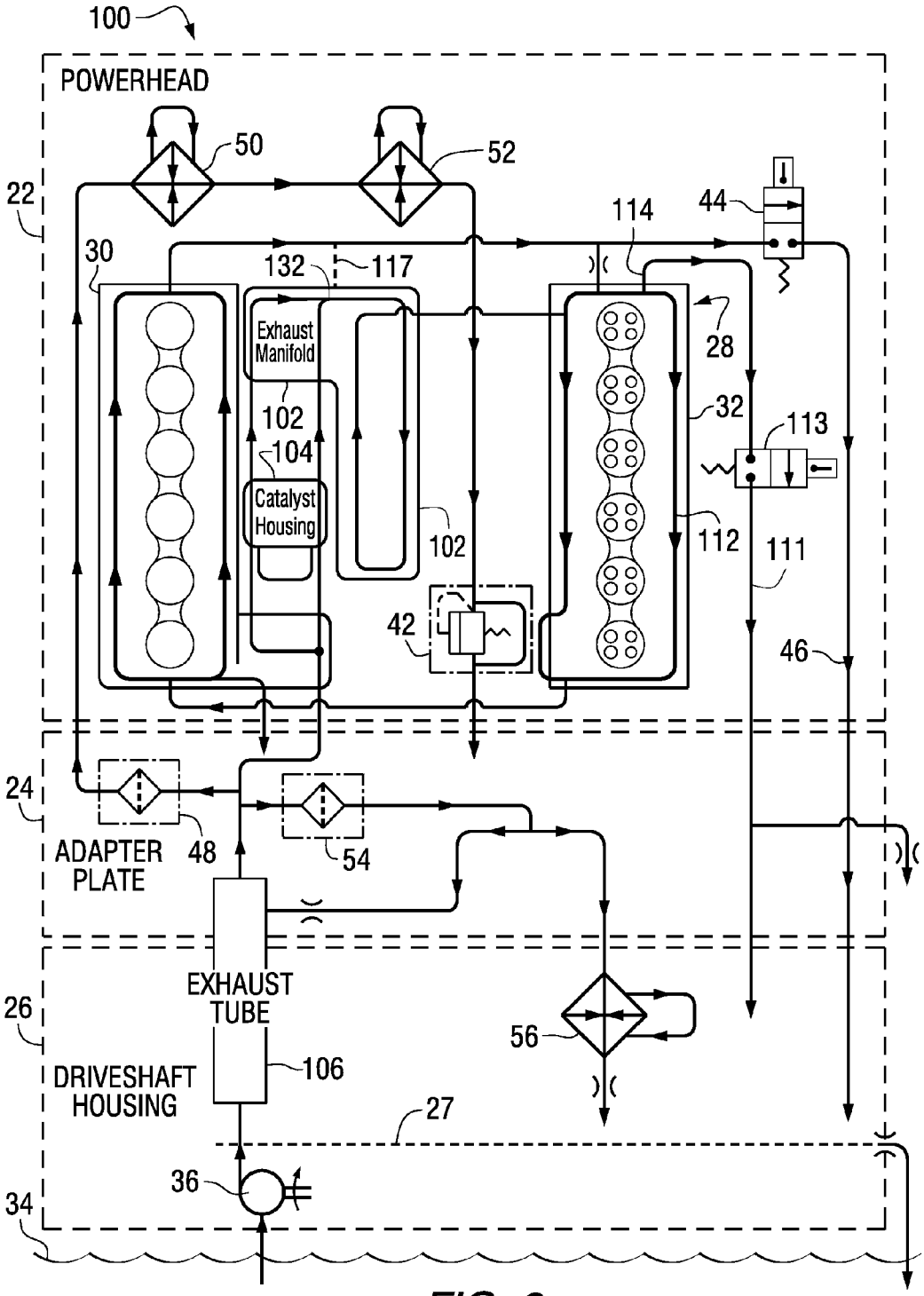
FIG. 3 is like FIG. 2 and shows another embodiment.
Figure 4:
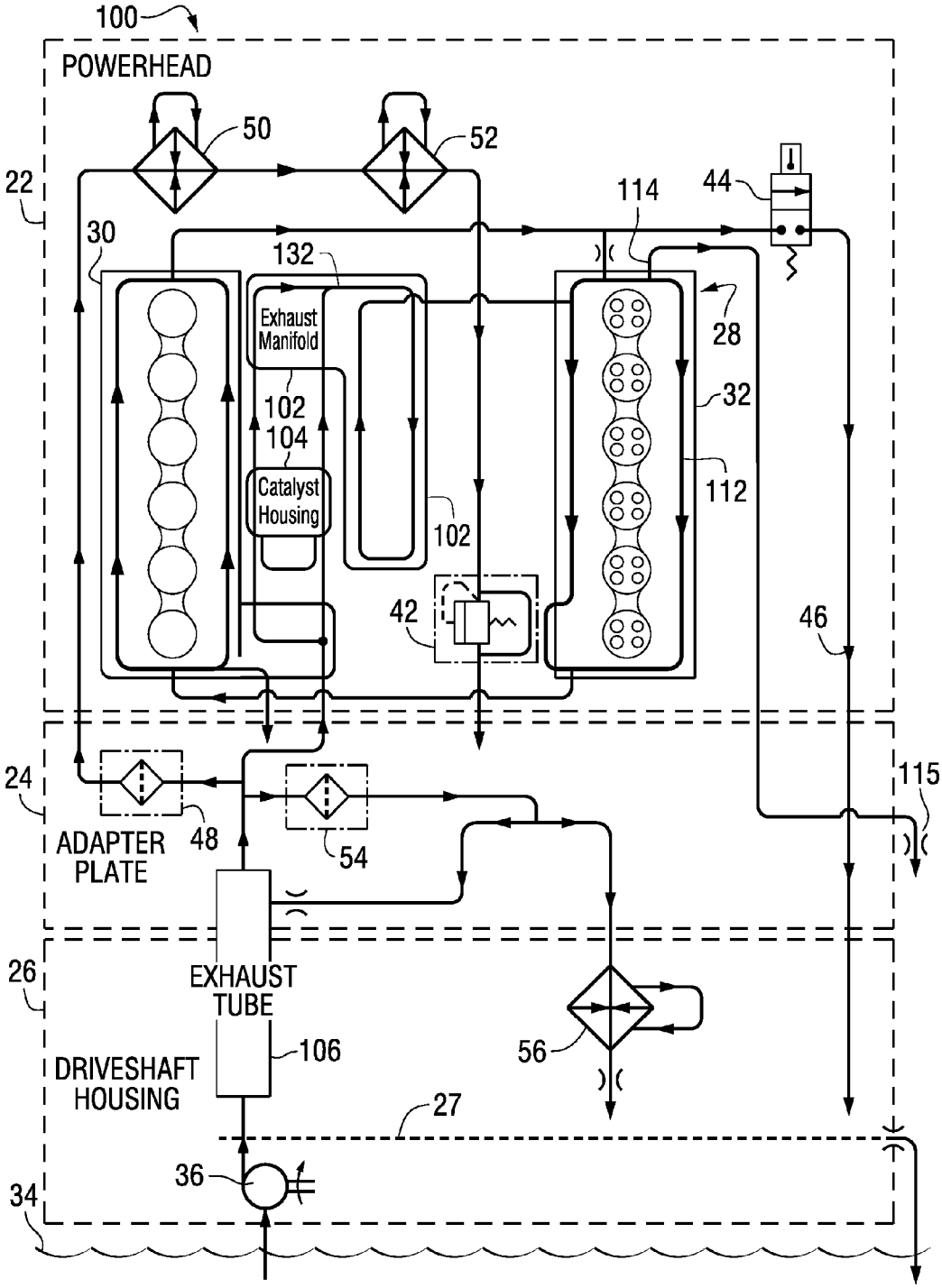
FIG. 4 is like FIG. 2 and shows another embodiment.
Figure 5:
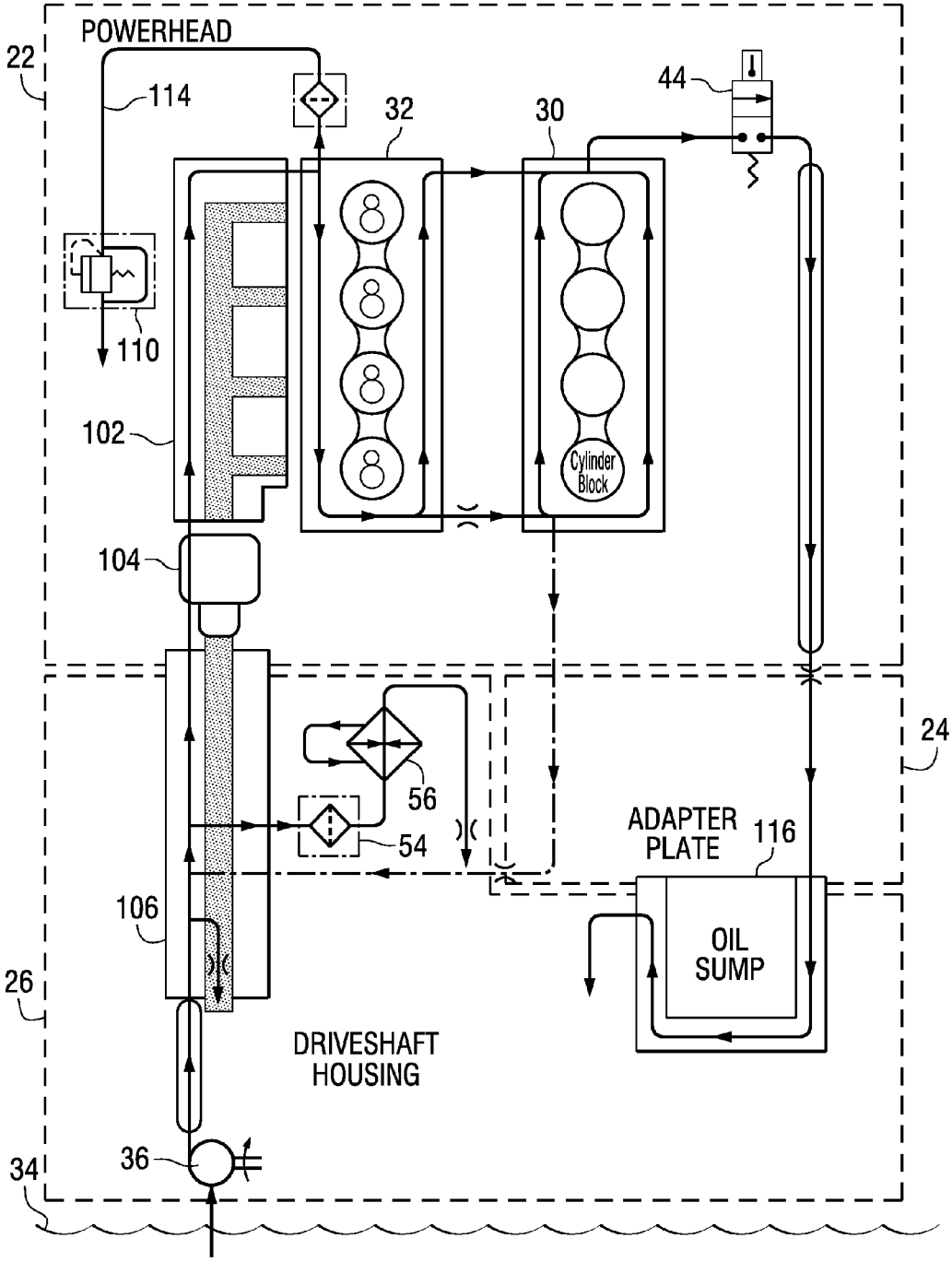
FIG. 5 is like FIG. 2 and shows another embodiment.
Figure 7:
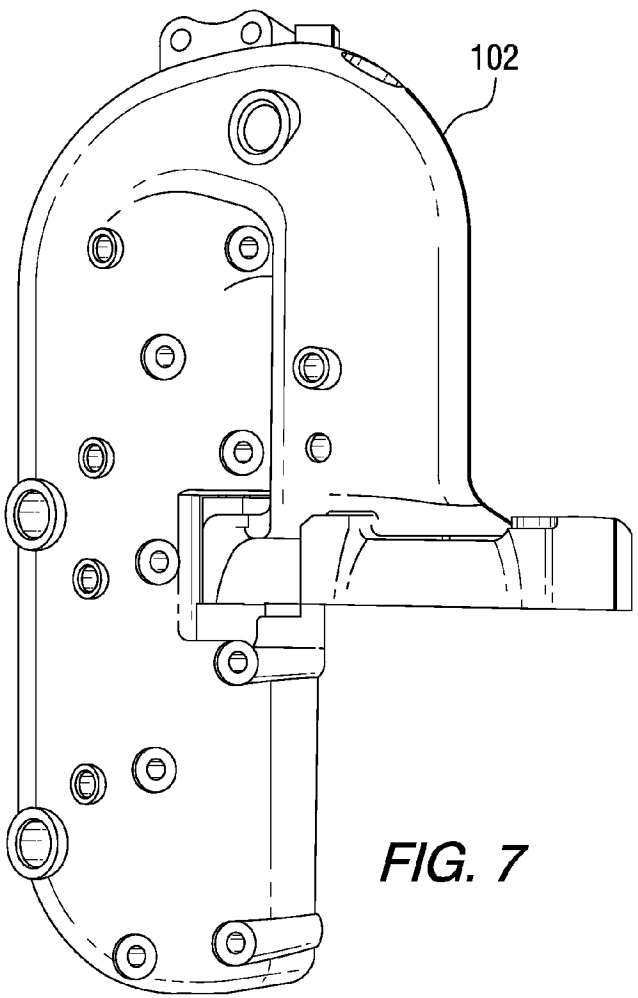
FIG. 7 is another view of the exhaust manifold of FIG. 6.
Figure 6:
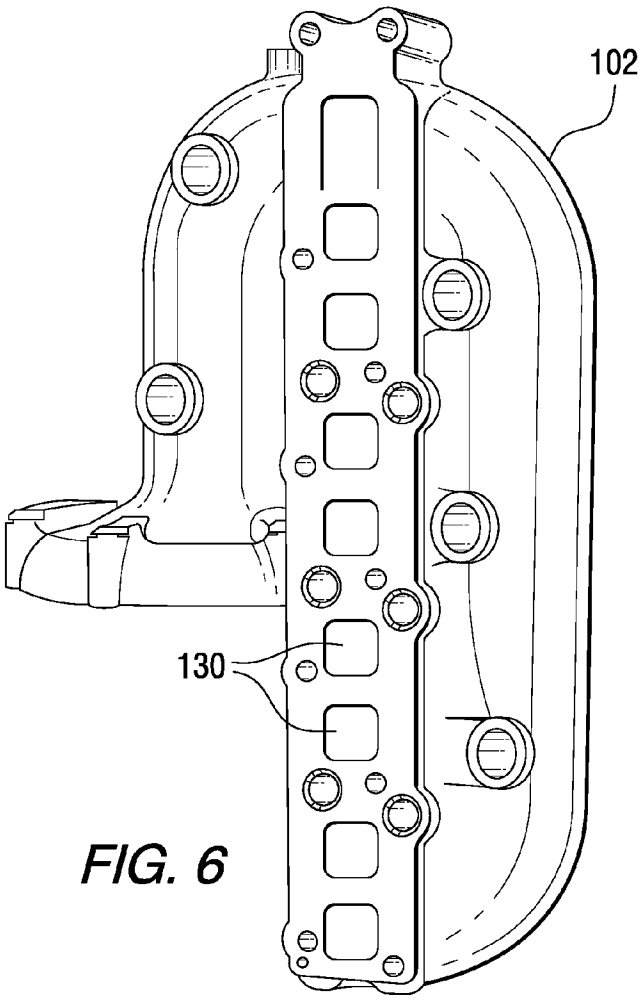
FIG. 6 shows an exhaust manifold in accordance with the disclosure.

In one embodiment, a cooling water control valve 110 is coupled to cylinder head 32 and controls the amount of added cooling water flow that the downstream components get over the flow going through the head and the block. In one embodiment, cooling water flow control valve 110 is a valve controlling the flow split between first and second paths, with the first path supplying cooling water through the cylinder head and the cylinder block as shown at arrow 112, and the second path diverting the cooling water as shown at arrow 114 away from the cylinder head and the cylinder block and returning the cooling water as shown at 111 back to the body of water 34 in which the outboard marine drive is operating. In FIG. 2, diverter valve 110 is a poppet valve, provided by a second poppet valve 110 in addition to the noted poppet valve 42. In FIG. 3, the diverter valve is a thermostat 113, provided by a second thermostat, in addition to the first noted thermostat 44. In FIG. 4, the diverter valve is a tell-tale orifice 115. In FIG. 5, the cooling water downstream of thermostat 44 is supplied to cool oil sump 116. In FIG. 5, water for poppet valve 110 comes from cylinder head 32. In FIGS. 2-5, the cooling water is passed through cooling passages of the exhaust system prior to passing through cooling passages of the cylinder head to pre-heat the cooling water sufficiently to avoid overcooling the exhaust and avoid condensate formation. Valve 110 provides a pre-heat control valve controlling pre-heated cooling water supplied through the cylinder head, e.g. by diverting more or less cooling water as shown at arrow 114 away from cylinder head 32.

Figure 8:
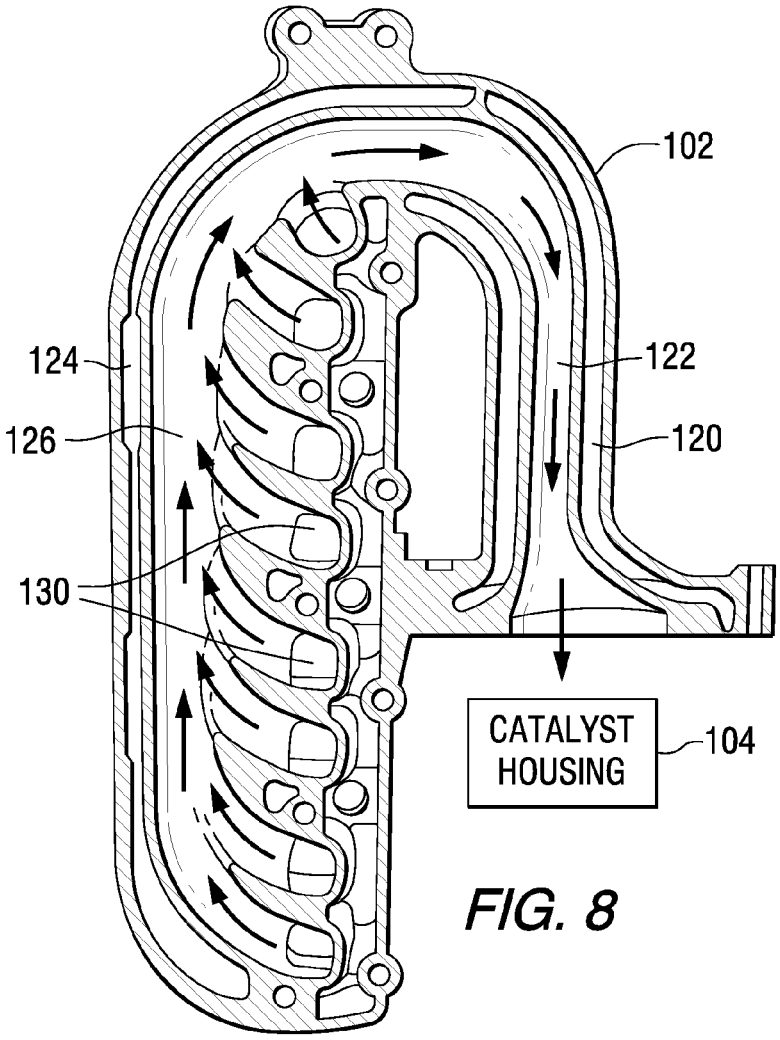
FIG. 8 is a sectional view of the exhaust manifold of FIG. 6.
Figure 9:
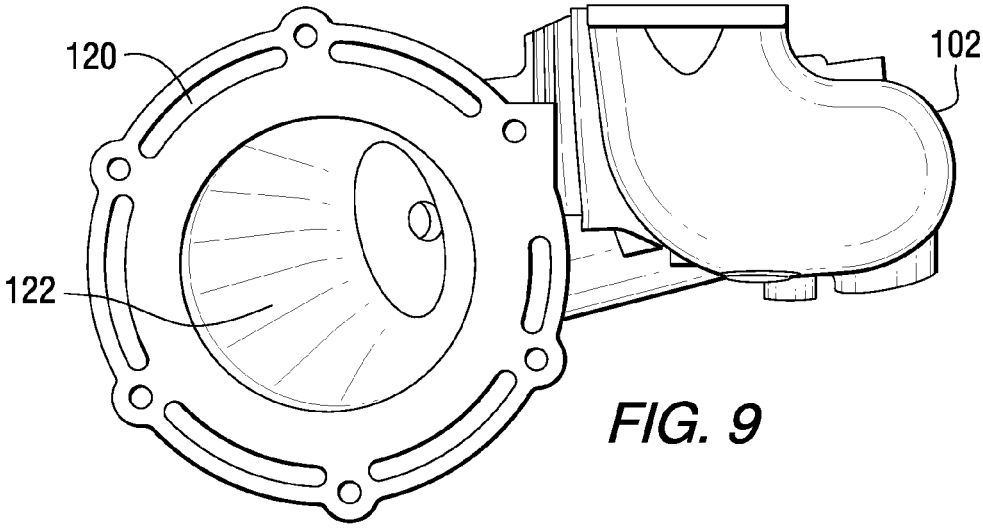
FIG. 9 is a view from below of the exhaust manifold of FIG. 6.
Figure 10:
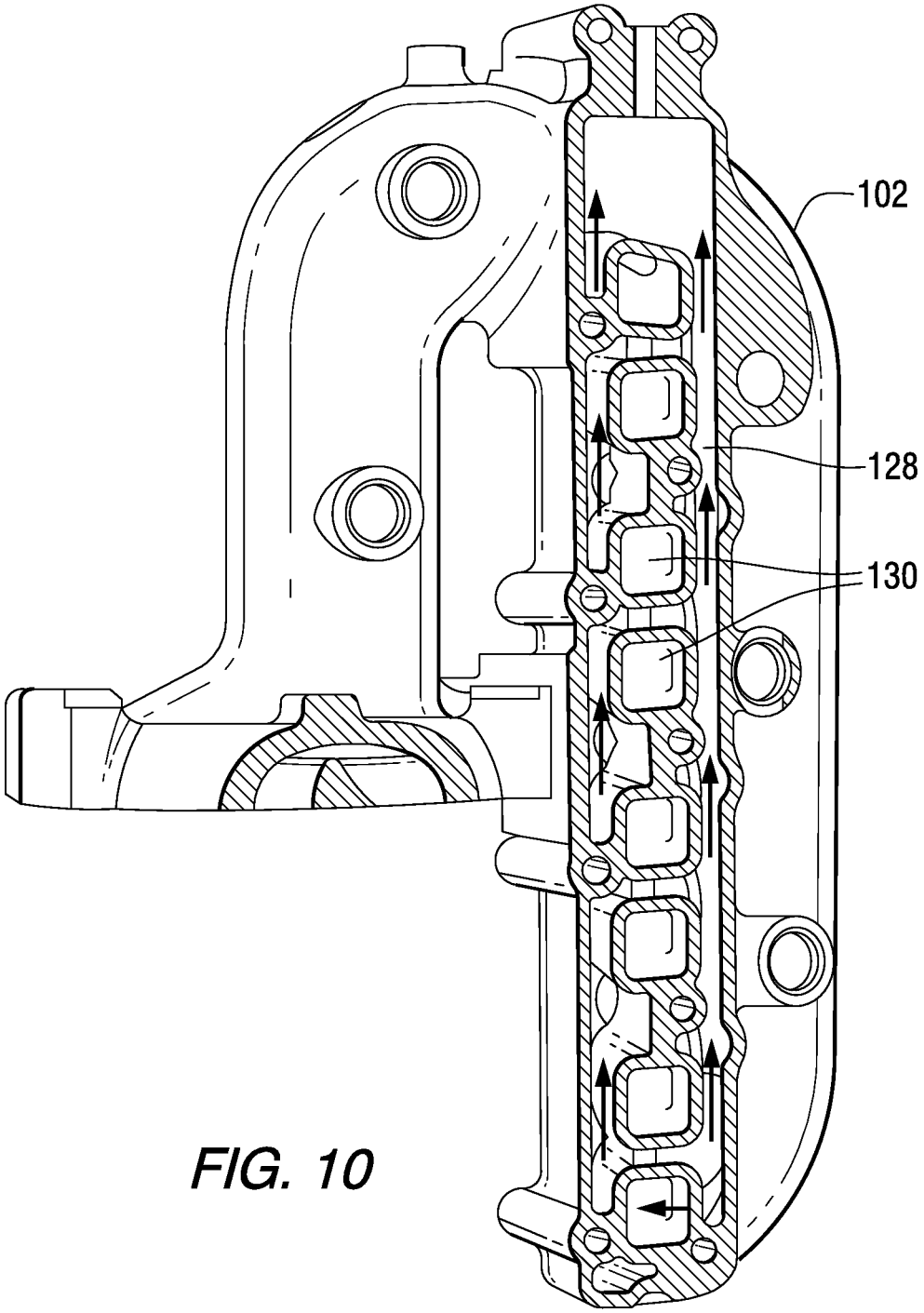
FIG. 10 is another sectional view of the exhaust manifold of FIG. 6.
Figure 11:
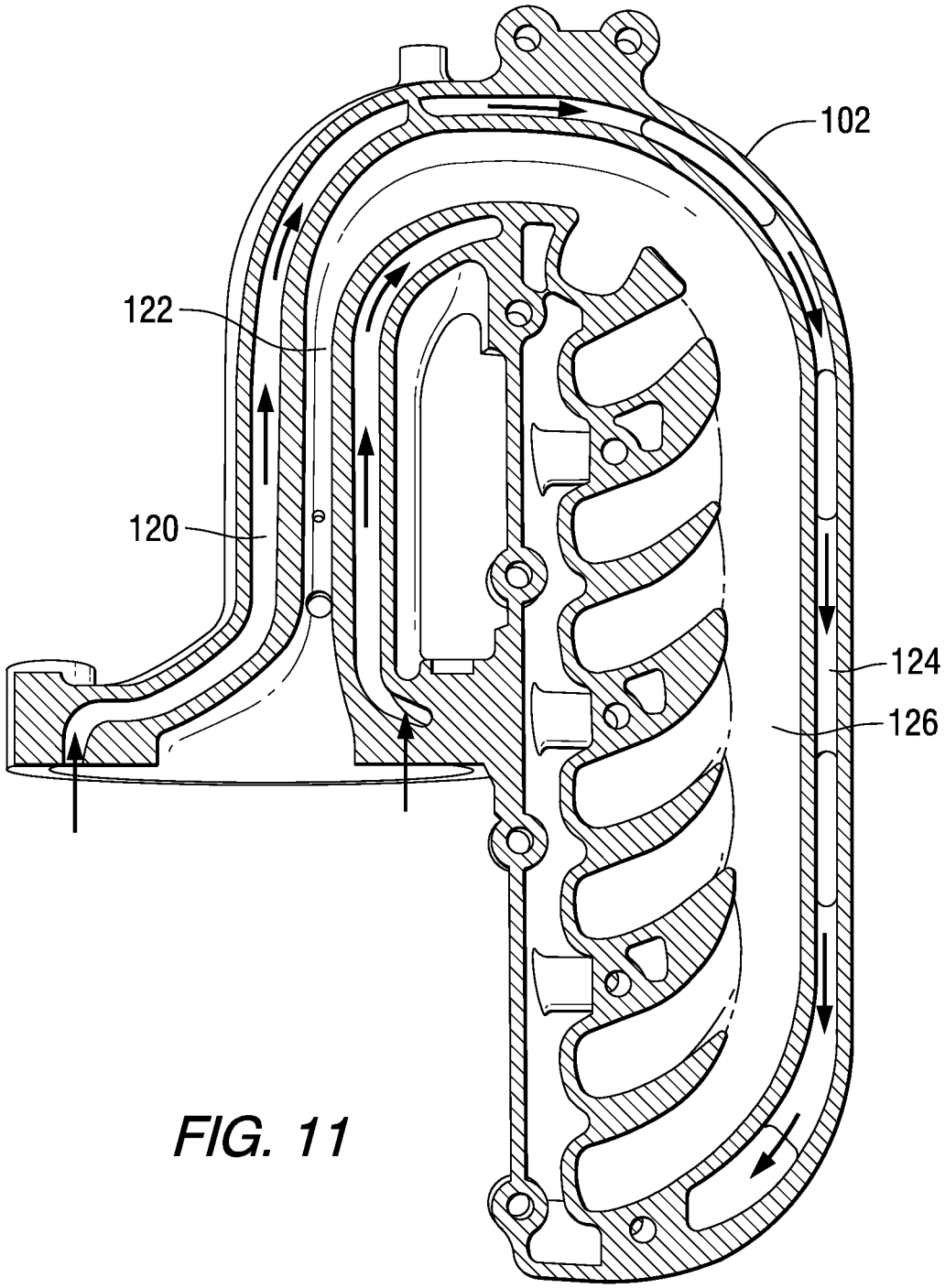
FIG. 11 is another sectional view of the exhaust manifold of FIG. 6.

FIGS. 6-11 show exhaust manifold 102 comprising a 3-pass manifold comprising: a first pass having an incoming cooling water flow passage 120, FIG. 11, in heat transfer relation with an outgoing exhaust flow passage 122, FIG. 8; a second pass having a transfer cooling water flow passage 124 in heat transfer relation with a transfer exhaust flow passage 126; and a third pass having an outgoing cooling water flow passage 128, FIG. 10, in heat transfer relation with one or more incoming exhaust flow passages 130 from respective cylinders in the cylinder head. Incoming cooling water flow passage 120 receives cooling water from the body of water 34 in which the marine drive is operating, and passes the cooling water to transfer cooling passage 124 and then to outgoing cooling water flow passage 128 for passage to the noted paths, including to cylinder head 32. Incoming exhaust flow passage 130 receives exhaust from the cylinder head and passes the exhaust to transfer exhaust flow passage 126 and then to outgoing exhaust flow passage 122. Outgoing cooling water flow passage 128 passes cooling water to a cooling passage in the cylinder head, as above. Outgoing exhaust flow passage 122 passes exhaust to catalyst housing 104 which has a cooling water flow passage receiving cooling water from the body of water 34 in which the marine drive is operating, and passes the cooling water to incoming water flow passage 120 of 3-pass manifold 102.

The system provides a method for preventing condensate formation in the cylinder head, catalyst housing, and exhaust manifold of the internal combustion engine of the powerhead in an outboard marine drive. The method includes providing a cooling system drawing cooling water from the body of water 34 in which the outboard marine drive is operating, and pre-heating the cooling water prior to passing the cooling water through cooling passages in the cylinder head sufficiently to avoid overcooling the exhaust and concomitant condensate formation. A further embodiment includes pre-heating the cooling water prior to passing the cooling water through cooling passages in the catalyst housing sufficiently to avoid overcooling the exhaust and concomitant condensate formation in the catalyst housing. A further embodiment includes pre-heating the cooling water prior to passing the cooling water through cooling passages in the exhaust manifold sufficiently to avoid overcooling the exhaust and concomitant condensate formation in the exhaust manifold. The method includes passing the cooling water through the cooling system in an opposite flow direction to exhaust flowing through the exhaust system in heat transfer relation with the cooling system. The method includes providing the exhaust system with an exhaust manifold, in some embodiments a catalyst housing, and an exhaust tube extending in the driveshaft housing, and passing the cooling water from the body of water 34 through cooling passages in exhaust tube 106, catalyst housing 104, and exhaust manifold 102 prior to passing the cooling water through cooling passages in cylinder head 32 and cylinder block 30. The method includes reducing transient overshoot in cooling water temperature by controlling the amount of pre-heated cooling water passed through the cylinder head. The method includes controlling the amount of pre-heated cooling water passed through the cylinder head by divertingly re-directing some of the pre-heated cooling water as shown at arrow 114 back to the body of water 34 in which the outboard marine drive is operating.

Outboard marine drive engines require special attention when designing a cooling system due to the open-loop nature of the cooling system. An outboard engine with a catalyst requires even more attention to ensure proper operation of the catalyst. It is important to maintain proper heat rejection from the exhaust gas to the cooling water in order to maintain the catalyst material at the appropriate operating temperature. Catalyst material that is too cold will not have optimum chemical conversion or treatment of the exhaust gas. Catalyst material that is too hot may dramatically and unnecessarily degrade the life of the catalyst. In open-loop cooling systems where cooling water from the body of water 34 can range from −2° C. to 38° C. (28° F. to 100° F.). The cooling system used for catalyzed outboard engines must be designed with exhaust gas heat rejection in mind. Further, the additional heat rejected to the cooling water in the exhaust system cooling system must be handled in such a way as to not degrade the transient response of the cooling system. The present system desirably addresses these concerns.

Figure 12:
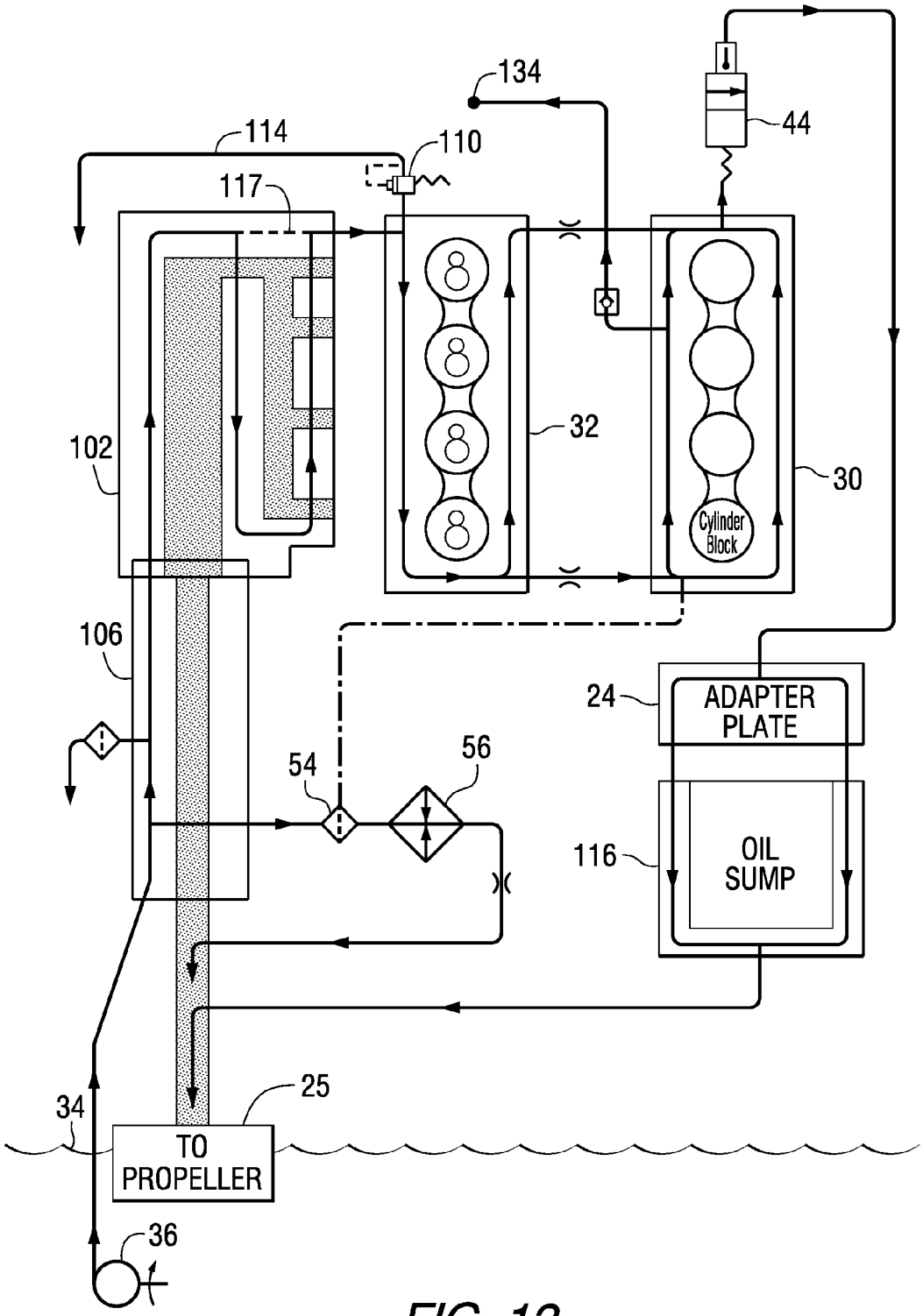
FIG. 12 is like FIG. 5 and shows a further embodiment.
Figure 13:
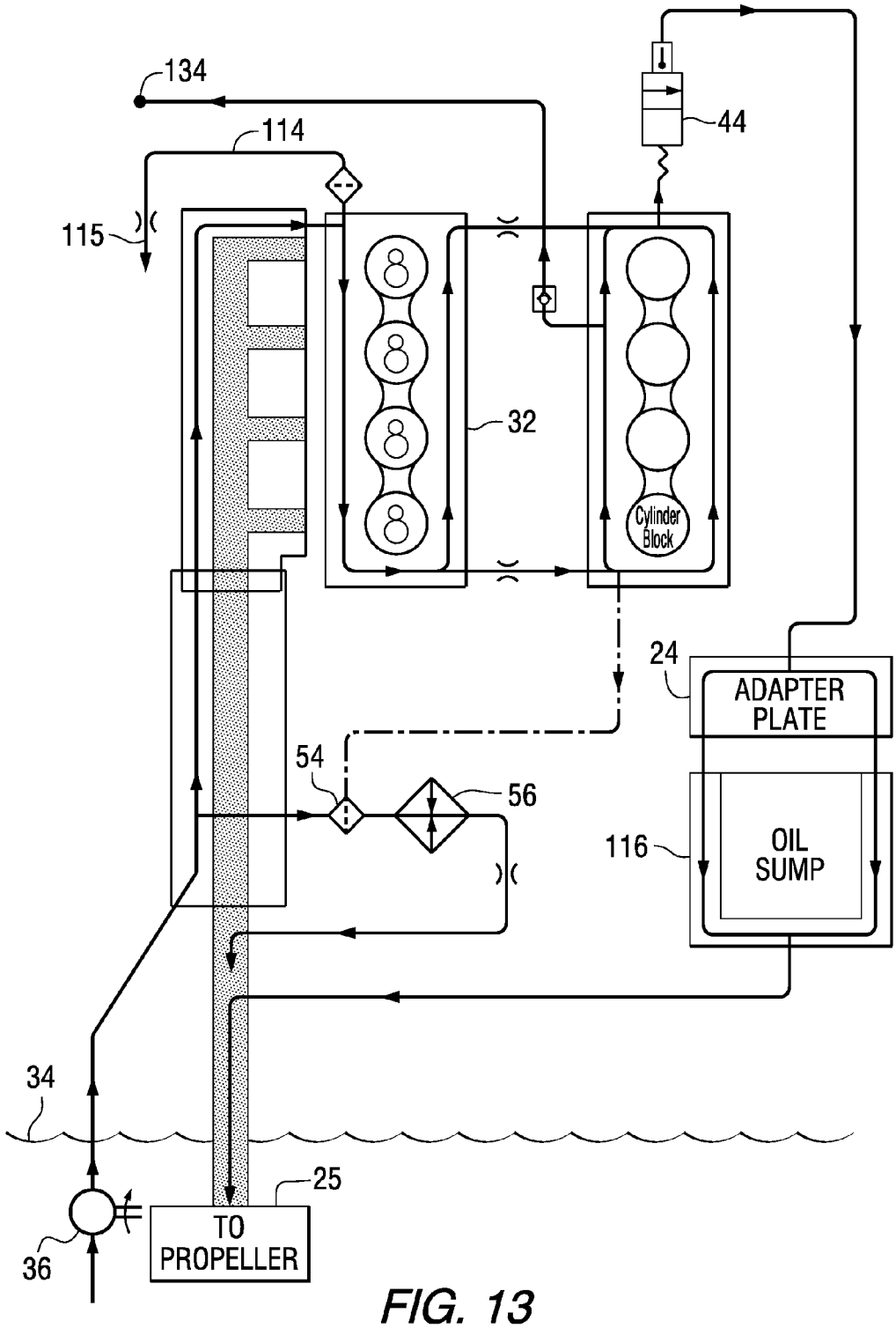
FIG. 13 is like FIG. 5 and shows a further embodiment.
Figure 14:
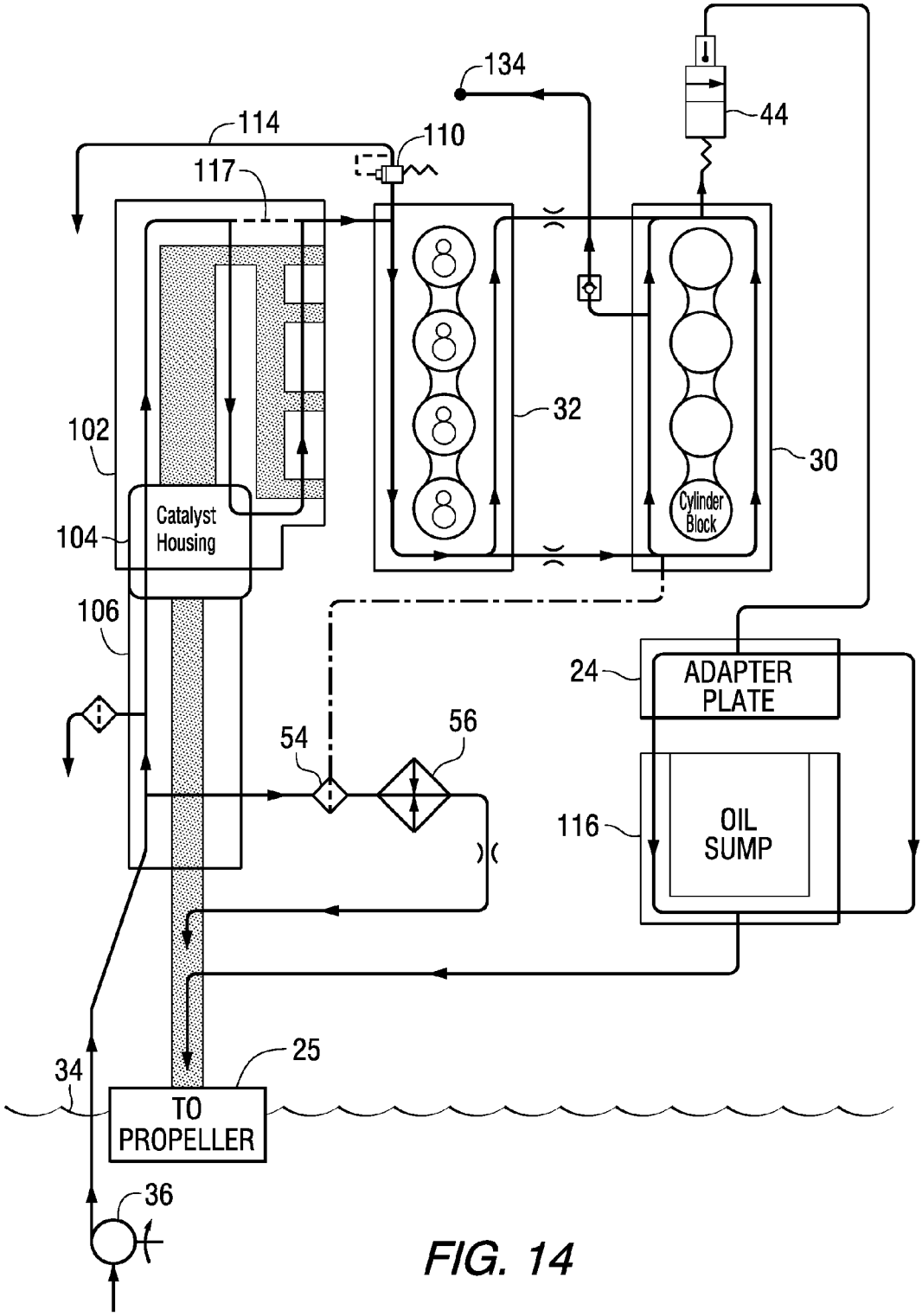
FIG. 14 is like FIG. 5 and shows a further embodiment.

FIGS. 12-14 show further embodiments and use like reference numerals from above where appropriate to facilitate understanding. FIG. 12 is like FIG. 5 and shows pressure control device or valve 110 coupled to the cylinder head. FIG. 12 shows a 3-pass manifold. FIG. 5 shows a single pass manifold. An air bleed is shown at 117. FIG. 13 is like FIG. 12 but uses the tell-tale orifice 115 of FIG. 4. FIG. 14 is like FIG. 12 and includes the catalyst housing 104. In FIGS. 12-14, a flush port 134 may be provided for flushing the cooling system.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. An outboard marine drive comprising a powerhead having an internal combustion engine, and a downwardly extending driveshaft housing having a lower gearcase driving a propulsor, said engine having a cylinder block and a cylinder head and expelling exhaust through an exhaust system having an exhaust manifold, and an exhaust tube, said exhaust tube extending in said driveshaft housing, a cooling system drawing cooling water from a body of water in which the outboard marine drive is operating, and supplying said cooling water through cooling passages along a majority of said exhaust tube and said exhaust manifold, and thereafter through cooling passages in said cylinder head and said cylinder block.

2. The outboard marine drive according to claim 1 wherein said exhaust flows in a first direction, said cooling water flows in a second direction, and said first and second directions are opposite to each other.

3. The outboard marine drive according to claim 1 wherein cooling water is passed through cooling passages of said exhaust system prior to passing through cooling passages of said cylinder head to pre-heat said cooling water sufficiently to avoid overcooling said exhaust and concomitant condensate formation.

4. The outboard marine drive according to claim 3 comprising a pre-heat control valve controlling pre-heated cooling water supplied through said cylinder head.

5. An outboard marine drive comprising a powerhead having an internal combustion engine, and a downwardly extending driveshaft housing having a lower gearcase driving a propulsor, said engine having a cylinder block and a cylinder head and expelling exhaust through an exhaust system having an exhaust manifold, a catalyst housing, and an exhaust tube, said exhaust tube extending in said driveshaft housing, a cooling system drawing cooling water from a body of water in which the outboard marine drive is operating, and supplying said cooling water through cooling passages along a majority of said exhaust tube, said catalyst housing, and said exhaust manifold, and thereafter through cooling passages in said cylinder head and said cylinder block.

6. The outboard marine drive according to claim 5 wherein said cooling water flowing through said cooling passages in said cylinder and said cylinder block is pre-heated by passing first through said cooling passages in said exhaust tube, said catalyst housing, and said exhaust manifold.

7. An outboard marine drive comprising a powerhead having an internal combustion engine, and a downwardly extending driveshaft housing having a lower gearcase driving a propulsor, said engine having a cylinder block and a cylinder head and expelling exhaust through an exhaust system having an exhaust manifold, a catalyst housing, and an exhaust tube, said exhaust tube extending in said driveshaft housing, a cooling system drawing cooling water from a body of water in which the outboard marine drive is operating, and supplying said cooling water through cooling passages in said exhaust tube, said catalyst housing, and said exhaust manifold, and thereafter through cooling passages in said cylinder head and said cylinder block;

wherein said cooling water flowing through said cooling passages in said cylinder and said cylinder block is pre-heated by passing first through said cooling passages in said exhaust tube, said catalyst housing, and said exhaust manifold;

wherein said cooling water flows sequentially in the following order, namely through said cooling passages in said exhaust tube then through cooling passages in said catalyst housing then through cooling passages in said exhaust manifold.

8. The outboard marine drive according to claim 7 wherein said cooling water flows to said cylinder head after leaving said exhaust manifold.

9. The outboard marine drive according to claim 6 wherein said cooling water and said exhaust flow in opposite directions in at least two of said exhaust tube, said catalyst housing, and said exhaust manifold.

10. The outboard marine drive according to claim 9 wherein said cooling water and said exhaust flow in opposite directions in all three of said exhaust tube, said catalyst housing, and said exhaust manifold.

11. The outboard marine drive according to claim 5 wherein said cooling water passed through said cooling passages of said exhaust tube, said catalyst housing, and said exhaust manifold pre-heats said cooling water prior to passing through cooling passages of said cylinder head to avoid overcooling said exhaust and concomitant condensate formation, and comprising a pre-heat control valve controlling said pre-heated cooling water supplied through said cylinder head.

12. The outboard marine drive according to claim 11 wherein said pre-heat control valve is a cooling water flow control valve coupled to said cylinder head and controlling cooling water passed through said cylinder head.

13. The outboard marine drive according to claim 12 wherein said cooling water flow control valve controls the temperature of said cooling water.

14. The outboard marine drive according, to claim 12 wherein said cooling water flow control valve controls the pressure of said cooling water.

15. The outboard marine drive according to claim 12 wherein said cooling water flow control valve controls both the temperature and the pressure of said cooling water.

16. The outboard marine drive according to claim 12 wherein said cooling water flow control valve controls the amount of cooling water flowing through said cylinder head.

17. An outboard marine drive comprising a powerhead having an internal combustion engine, and a downwardly extending driveshaft housing having a lower gearcase driving a propulsor, said engine having a cylinder block and a cylinder head and expelling exhaust through an exhaust system having an exhaust manifold, a catalyst housing, and an exhaust tube, said exhaust tube extending in said driveshaft housing, a cooling system drawing cooling water from a body of water in which the outboard marine drive is operating, and supplying said cooling water through cooling passages in said exhaust tube, said catalyst housing, and said exhaust manifold, and thereafter through cooling passages in said cylinder head and said cylinder block;

wherein said cooling water passed through said cooling passages of said exhaust tube, said catalyst housing, and said exhaust manifold pre-heats said cooling water prior to passing through cooling passages of said cylinder head to avoid overcooling said exhaust and concomitant condensate formation, and comprising a pre-heat control valve controlling said pre-heated cooling water supplied through said cylinder head;

wherein said pre-heat control valve is a cooling water flow control valve coupled to said cylinder head and controlling cooling water passed through said cylinder head;

wherein said cooling water flow control valve is a diverter valve splitting said cooling water flowing through said cooling passage in said cylinder head into first and second paths, said first path supplying said cooling water through said cylinder head and said cylinder block, said second path diverting said cooling, water away from said cylinder head.

18. The outboard marine drive according to claim 17 wherein said second path supplies said cooling water back to said body of water in which said outboard marine drive is operating.

19. The outboard marine drive according to claim 17 wherein said diverter valve is a poppet valve.

20. The outboard marine drive according to claim 17 wherein said diverter valve is a thermostat.

21. The outboard marine drive according to claim 17 wherein said diverter valve is an orifice.

22. An exhaust manifold for an outboard marine drive having a powerhead having an internal combustion engine and having a downwardly extending driveshaft housing having a lower gearcase driving a propulsor, said engine having a cylinder block and a cylinder head and expelling exhaust through an exhaust system having said exhaust manifold, said exhaust manifold comprising a 3-pass manifold comprising:

a first pass having an incoming cooling water flow passage in heat transfer relation with an outgoing exhaust flow passage;

a second pass having a transfer cooling water flow passage in heat transfer relation with a transfer exhaust flow passage;

a third pass having an outgoing cooling water flow passage in heat transfer relation with an incoming exhaust flow passage;

said incoming cooling water flow passage receiving cooling water from a body of water in which the outboard marine drive is operating and passing said cooling water to said transfer cooling water flow passage and then to said outgoing cooling water flow passage;

said incoming exhaust flow passage receiving exhaust from said cylinder head and passing said exhaust to said transfer exhaust flow passage and then to said outgoing exhaust flow passage.

23. The exhaust manifold according to claim 22 wherein said outgoing cooling water flow passage passes cooling water to a cooling passage in said cylinder head.

24. The exhaust manifold according to claim 22 wherein said outgoing exhaust flow passage passes exhaust to a catalyst housing, and wherein said catalyst housing has a cooling water how passage receiving cooling water from said body of water in which said outboard marine drive is operating and passing said cooling water to said incoming cooling water flow passage of said 3-pass manifold.

25. An outboard marine drive comprising a powerhead having an internal combustion engine, and a downwardly extending driveshaft housing having a lower gearcase driving a propulsor, said engine having a cylinder block and a cylinder head and expelling exhaust through an exhaust system having, an exhaust manifold, and an exhaust tube, said exhaust tube extending in said driveshaft housing, a cooling system drawing cooling water from a body of water in which the outboard marine drive is operating, and supplying said cooling water through cooling passages in said exhaust tube and said exhaust manifold, and thereafter through cooling passages in said cylinder head and said cylinder block, wherein said cooling water is passed through cooling passages of said exhaust system prior to passing, through cooling passages of said cylinder head to pre-heat said cooling water sufficiently to avoid overcooling said exhaust and concomitant condensate formation, said exhaust manifold comprising a 3-pass manifold comprising a first pass having an incoming cooling water flow passage in heat transfer relation with an outgoing exhaust flow passage, a second pass having a transfer cooling water flow passage in heat transfer relation with a transfer exhaust flow passage, a third pass having an outgoing cooling water flow passage in heat transfer relation with an incoming exhaust flow passage, wherein said incoming cooling water flow passage receives cooling water from said body of water in which the outboard marine drive is operating and passes said cooling water to said transfer cooling water flow passage and then to said outgoing cooling water flow passage, and wherein said incoming exhaust flow passage receives exhaust from said cylinder head and passes said exhaust to said transfer exhaust flow passage and then to said outgoing exhaust flow passage.

26. The outboard marine drive according to claim 25 wherein said exhaust system includes a catalyst housing, and exhaust is expelled through said exhaust manifold, said catalyst housing, and said exhaust tube, and cooling water is supplied through cooling passages in said exhaust tube, said catalyst housing, and said exhaust manifold, and wherein said outgoing exhaust flow passage of said 3-pass manifold passes exhaust to said catalyst housing, and wherein said cooling water flow passage of said catalyst housing receives cooling water from said body of water in which said marine drive is operating and passes said cooling water to said incoming cooling water flow passage of said 3-pass manifold.

27. A method for preventing, condensate formation in a cylinder head of an internal combustion engine of a powerhead in an outboard marine drive, said powerhead having said internal combustion engine having a cylinder block and said cylinder head, said outboard marine drive having a downwardly extending driveshaft housing having a lower gearcase driving a propulsor, said cylinder head expelling exhaust through an exhaust system, said method comprising providing a cooling system drawing cooling water from a body of water in which said outboard marine drive is operating and pre-heating said cooling water prior to passing said cooling water through cooling passages in said cylinder head sufficiently to avoid overcooling said exhaust and concomitant condensate formation;

wherein said internal combustion engine includes an exhaust manifold, and comprising pre-heating said cooling water and then passing said cooling water through cooling passages in said exhaust manifold sufficiently to avoid overcooling said exhaust and concomitant condensate formation;

passing said cooling water through said cooling system in an opposite flow direction to exhaust flowing through said exhaust system in heat transfer relation with said cooling system; and Providing said exhaust system with an exhaust manifold and an exhaust tube, said exhaust tube extending in said driveshaft housing, and comprising passing said cooling water from said body of water through cooling passages along a majority of said exhaust tube and said exhaust manifold prior to passing said cooling water through cooling passages in said cylinder head.

28. The method according to claim 27 comprising providing said exhaust system with an exhaust manifold, a catalyst housing, and an exhaust tube, said exhaust tube extending in said driveshaft housing, and comprising passing said cooling water from said body of water through cooling passages in said exhaust tube, said catalyst housing, and said exhaust manifold prior to passing said cooling water through cooling passages in said cylinder head.

29. The method according to claim 27 comprising reducing transient overshoot in cooling water temperature by controlling the pre-heated cooling water passed through said cylinder head.

30. The method according to claim 29 comprising controlling the temperature and pressure of said pre-heated cooling water passed through said cylinder head.

31. A method for preventing condensate formation in a cylinder head of an internal combustion engine of a powerhead in an outboard marine drive, said powerhead having said internal combustion engine having a cylinder block and said cylinder head, said outboard marine drive haying a downwardly extending driveshaft housing having a lower gearcase driving a propulsor, said cylinder head expelling exhaust through an exhaust system, said method comprising providing a cooling system drawing cooling water from a body of water in which said outboard marine drive is operating and pre-heating said cooling water prior to passing said cooling water through cooling passages in said cylinder head sufficiently to avoid overcooling said exhaust and concomitant condensate formation:

providing said exhaust system with an exhaust manifold and an exhaust tube, said exhaust tube extending in said driveshaft housing, and comprising passing said cooling water from said hod of water through cooling passages in said exhaust tube and said exhaust manifold prior to passing said cooling water through cooling passages in said cylinder head;

reducing transient overshoot in cooling water temperature by controlling the pre-heated cooling water passed through said cylinder head; and controlling, said pre-heated cooling water passed through said cylinder head by divertingly re-directing some of said pre-heated cooling water back to said body of water in which said outboard marine drive is operating.

32. A method for preventing condensate formation in a cylinder head of an internal combustion engine of a powerhead in an outboard marine drive, said powerhead having said internal combustion engine engine having a cylinder block and said cylinder head, said outboard marine drive having a downwardly extending driveshaft housing having a lower gearcase driving a propulsor, said cylinder head expelling exhaust through an exhaust system, said method comprising providing a cooling system drawing cooling water from a body of water in which said outboard marine drive is operating and pre-heating said cooling water prior to passing said cooling water through cooling passages in said cylinder head sufficiently to avoid overcooling said exhaust and concomitant condensate formation;

providing said exhaust systerm with an exhaust manifold and an exhaust tube, said exhaust tube extending in said driveshaft housing, and comprising passing said cooling water from said body of water through cooling passages in said exhaust tube and said exhaust manifold prior to passing said cooling water through cooling passages in said cylinder head;

reducing transient overshoot in cooling water temperature by controlling the pre-heated cooling water passed through said cylinder head; and controlling said pre-heated cooling water passed through said cylinder head by divertingly re-directing some of said pre-heated cooling water from said cylinder head back to said body of water in which said outboard marine drive is operating.

* * * * *

UNITED STATES PATENT AND TRADEMARK OFFICE

CERTIFICATE OF CORRECTION

PATENT NO. : 8,500,501 B1
APPLICATION NO. : 13/163904
DATED : August 6, 2013
INVENTOR(S) : Christopher J. Taylor et al.

It is certified that error appears in the above-identified patent and that said Letters Patent is hereby corrected as shown below:

On the Title Page, Item (73)

Please amend the Assignee's city of location as follows.

--Lake Forest--

Signed and Sealed this
Seventeenth Day of September, 2013

Teresa Stanek Rea
*Deputy Director of the United States Patent and Trademark Office*